US010920152B2

(12) United States Patent
Snow et al.

(10) Patent No.: US 10,920,152 B2
(45) Date of Patent: Feb. 16, 2021

(54) REACTOR AND METHOD FOR UPGRADING HEAVY HYDROCARBONS WITH SUPERCRITICAL FLUIDS

(71) Applicant: PyroPhase, Inc., Chicago, IL (US)

(72) Inventors: Richard H. Snow, Chicago, IL (US); Geoffrey Presley, Spokane, WA (US); Jesse Mohrbacher, Anchorage, AK (US)

(73) Assignee: PyroPhase, Inc., Chicago, IL (US)

( * ) Notice: Subject to any disclaimer, the term of this patent is extended or adjusted under 35 U.S.C. 154(b) by 186 days.

(21) Appl. No.: 15/438,384

(22) Filed: Feb. 21, 2017

(65) Prior Publication Data

US 2017/0240819 A1 Aug. 24, 2017

Related U.S. Application Data

(60) Provisional application No. 62/389,318, filed on Feb. 23, 2016.

(51) Int. Cl.
*C10G 9/00* (2006.01)
*C10G 1/10* (2006.01)
(Continued)

(52) U.S. Cl.
CPC ..... *C10G 9/00* (2013.01); *C10G 1/02* (2013.01); *C10G 1/083* (2013.01); *C10G 1/10* (2013.01);
(Continued)

(58) Field of Classification Search
CPC . C10G 9/00; C10G 31/08; C10G 9/36; C10G 1/02; C10G 1/083; C10G 1/10;
(Continued)

(56) References Cited

U.S. PATENT DOCUMENTS 4,486,293 A * 12/1984 Garg ..... C10G 1/086 208/420
4,564,458 A 1/1986 Burleson
(Continued)

FOREIGN PATENT DOCUMENTS

WO WO 79/000791 A1 10/1979
WO WO 02/098553 A1 12/2002

OTHER PUBLICATIONS

Peet et al, Prediction of thermal conductivity of Steel, 2011, International Journal of Heat and Mass Transfer, 54, 2602-2608 (Year: 2011).*

(Continued)

*Primary Examiner* — Randy Boyer
*Assistant Examiner* — Juan C Valencia
(74) *Attorney, Agent, or Firm* — McCracken & Gillen LLC

(57) ABSTRACT

Heavy hydro-carbonaceous materials such as bitumen are upgraded in supercritical water in a continuous-flow reactor system. The present invention provides a reactor arrangement for and a method of converting bitumen and other highly viscous hydrocarbon containing materials into pumpable liquids to enable further processing of such materials while avoiding production of char. The process can be carried out in an underground reactor based on oil well technology. The reactor design and method facilitates mass transfer to dissolve bitumen in heated water and breaks down heavy hydrocarbons by controlling the temperature and pressure in zones within the flowing stream. The reactor may include an embedded electric heater.

12 Claims, 6 Drawing Sheets

(51) Int. Cl.

| | |
|---|---|
| ***C10G 1/08*** | (2006.01) |
| ***C10G 1/02*** | (2006.01) |
| ***C10G 9/36*** | (2006.01) |
| ***C10G 31/08*** | (2006.01) |
| ***C10G 11/00*** | (2006.01) |
| ***E21B 43/24*** | (2006.01) |

(52) U.S. Cl.
CPC ..... *C10G 9/36* (2013.01); *C10G 11/00* (2013.01); *C10G 31/08* (2013.01); *E21B 43/24* (2013.01); *E21B 43/2401* (2013.01); *C10G 2300/805* (2013.01)

(58) Field of Classification Search
CPC ..... C10G 11/00; C10G 2300/805; E21B 43/2401; E21B 43/24
See application file for complete search history.

(56) References Cited

U.S. PATENT DOCUMENTS

| | | | |
|---|---|---|---|
| 4,792,408 | A | 12/1988 | Titmas |
| 4,929,348 | A | 5/1990 | Rice |
| 5,454,950 | A | 10/1995 | Li et al. |
| 5,681,449 | A | 10/1997 | Yokoyama et al. |
| 5,851,430 | A | 12/1998 | Chirinos et al. |
| 5,932,182 | A | 8/1999 | Blaney |
| 6,602,917 | B1 | 8/2003 | Leal Calderon et al. |
| 6,877,369 | B2 | 4/2005 | Matsunaga et al. |
| 7,608,170 | B1 * | 10/2009 | Ousey ..... C10B 57/04 |
| 7,891,421 | B2 | 2/2011 | Kasevich |
| 7,921,907 | B2 | 4/2011 | Burnham et al. |
| 8,210,256 | B2 | 7/2012 | Bridges |
| 8,365,823 | B2 | 2/2013 | Dreher, Jr. et al. |
| 8,408,294 | B2 | 4/2013 | Bridges |
| 8,789,599 | B2 | 7/2014 | Parsche |
| 8,807,220 | B2 | 8/2014 | Madison et al. |
| 8,851,170 | B2 | 10/2014 | Ayodele et al. |
| 9,181,780 | B2 | 11/2015 | Zhang et al. |
| 2003/0062163 | A1 | 4/2003 | Moulton et al. |
| 2008/0135496 | A1 | 6/2008 | Joussot-Dubien et al. |
| 2009/0206006 | A1 | 8/2009 | Alla |
| 2011/0163011 | A1 | 7/2011 | Larbro |

OTHER PUBLICATIONS

Hurt et al, Comparison of the Structures of Molecules in Coal and Petroleum Asphaltenes by Using Mass Spectrometry, 2013, Energy and Fuels, 27, 3653-3658 (Year: 2013).*

Caniaz, RO, Erkey, C, Process intensification for heavy oil upgrading using supercritical water, Chemical Engineering Research and Design 92 (2014) 1845-1863.

Cheng, ZM, Ding, Y, Zhao, LQ, Yuan, PQ, Yuan, WK, Effects of supercritical water in vacuum residue upgrading, Energy and Fuels 23 (2009) 3178-3183.

Fedyaeva, ON, Shatrova, AV, Vostrikov, AA, Effect of temperature on bitumen conversion in a supercritical water flow, Journal of Supercritical Fluids 95 (2014), 437-443.

Han, LN, Zhang, R, Bi, JC, Cheng, LM, Pyrolysis of coal-tar asphaltene in supercritical water, Journal Analytical and Applied Pyrolysis 91 (2011), 281-287.

Kozhevnikov, IV, Nuzhdin, AL, Martyanov, ON, Transformation of petroleum asphaltenes in supercritical water, Journal of Supercritical Fluids 55 (2010), 217-222.

Kruse, A, Dinjus, E, Hot compressed water as reaction medium and reactant-Properties and synthesis reactions, Journal of Supercritical Fluids 39 (2007), 362-380.

Li, N, Yan, B, Xian-Ming, X, A review of laboratory-scale research on upgrading heavy oil in supercritical water, Energies 8 (2015), 8962-8989.

Liu, Y, Bai, F, Zhu, CC, Yuan, PQ, Cheng, ZM, Yuan, WK, Upgrading of residual oil in sub- and supercritical water: an experimental study, Fuel Processing Technology 106 (2013), 281-288.

Morimoto, M, Sugimoto, Y, Sato, S, Takanohashi, T, Solvent effect of water on supercritical water treatment of heavy oil, Journal Japan Petroleum Institute 57 (1), (2014), 11-17.

Morimoto, M, Sugimoto, Y, Sato, S, Takanohashi, T, Bitumen cracking in supercritical water upflow, Energy and Fuels, vol. 28, pp. 858-861, 2014.

Sato, T, Adschiri, T, Arai, K, Rempel, GL, Ng, FTT, Upgrading of asphalt with and without partial oxidation in supercritical water, Fuel 82 (2003), 1231-1239.

Timko, MT, Ghoniem, AF, Green, WH, Upgrading and desulfurization of heavy oils by supercritical water, Journal of Supercritical Fluids, vol. 96, pp. 114-123, 2015.

Vilcaez, J, Watanabe, M, Watanabe, N, Kishita, A, Adschiri, T, Hydrothermal extractive upgrading of bitumen without coke formation, Fuel, vol. 102, pp. 379-3858, 2012. journal homepage: www.elsevier.com/lo cate/fuel.

Song, C., Lai, W-C, and Schobert, HH, Hydrogen-transferring pyrolysis of cyclic and straight-chain hydrocarbons. Enhancing high temperature thermal stability of aviation jet fuels by h-donors, Fuel Science Program, Department of Materials Science and Engineering, 200 Academic Projects Building, The Pennsylvania State Universite, Universtiy Park, PA 16802.

Advanced Motor Fuels, Implementing Agreement, http://www.iea-amf.org/content/fuel_information/diesel_gasoline.

Barton, P., Supercritical separation in Aqueous Coal Liquefaction with Impregnated Catalyst, Ind. Eng. Chem. Process Dev. Des., vol. 22, pp. 589-594, 1983.

Ross, D.S. et al, Supercritical Water/CO Liquefaction and a Model for Coal Conversion, Fuel Processing Technology, vol. 12, pp. 277-285, 1986.

Onsri, K. et al, Co-Liquefaction of Coal and Used Tire in Supercritical Water, Energy and Power Engineering vol. 2, pp. 95-102, 2010.

Salomon, D. (assembler) for the Transportation Research Board Characteristics of Bituminous Materials Committee, Asphalt Emulsion Technologies, Transportation Research Circular E-C102, National Academies Press, 2006.

Sola, N.Q. Highly concentrated bitumen emulsions A state of the art, review of experimental results, Universitat de Lleida, Escola Politecnica Superior, Jul. 2013.

Morimoto, M., Sugimoto, Y., Saotome, Y., Sato, S., Takanohashi, T., Effect of supercritical water on upgrading reaction of oil sand bitumen, Journal of Supercritical Fluids, vol. 55 pp. 223-231, 2010.

International Search Report and Written Opinion in related PCT Application No. PCT/US2017/019210, dated May 22, 2017, 9 pages.

Extended European Search Report in related EP Application No. 170757247, dated Sep. 12, 2019, 6 pages.

* cited by examiner

REACTOR AND METHOD FOR UPGRADING HEAVY HYDROCARBONS WITH SUPERCRITICAL FLUIDS

CROSS REFERENCE TO RELATED APPLICATIONS

This application claims priority from U.S. Provisional Application 63/389,318 filed Feb. 23, 2016.

FIELD OF THE INVENTION

This invention relates to the treatment of highly viscous hydrocarbon containing materials. More particularly this invention relates to the thermal treatment of materials with supercritical fluids to produce a flowable mixture containing lower molecular weight hydrocarbons.

BACKGROUND OF THE INVENTION

The utilization of heavy hydro-carbonaceous materials (HCM), such as the bitumen from oil sands of Canada and Utah require treatment to reduce their viscosity so they can be shipped from remote producing regions to refineries. Bitumen is usually upgraded either by hydro-treating or delayed coking. Hydro-treating is costly especially in remote locations.

Delayed coking operates at high temperature, typically 500° C. or greater and results in bitumen giving up its hydrogen to form char. While hydrogen may go to lighter products, the yield of lighter products is less than 80%. Delayed coking equipment is also very large, costly and difficult to ship to and operate in remote locations where bitumen is often produced. In addition, delayed coking suffers from its discontinuous operation that requires labor-intensive effort to remove coke from the reactor after each batch.

Other methods include diluting with solvents or thermal upgrading and have been used to treat such materials. Solvents add cost because they must be shipped to the producing site, and again must be recovered by distillation at the refinery and shipped back.

Economically producing liquid products from other HCM such as coal, lignite and waste tires has long been a goal of research efforts. Treatment of such materials with supercritical water (SCW) has been recognized as having potential in this application.

The technology described here is not the same as in-situ upgrading, which thermally cracks the bitumen while it is being produced from the reservoir. This involves numerous technical difficulties and has so far not been successfully done on a commercial scale. Instead, this invention treats the bitumen after it has been produced. This separate treatment allows better control of process conditions.

When bitumen is heated above 300° C. it reacts partly to form lighter products with lower molecular weight, but also polymerizes to form char. If bitumen is first dissolved in SCW it is protected from forming char. Furthermore, it is suggested that the mixing of viscous bitumen into hot SCW would be challenging. See Timko (36). It has also been observed that when bitumen droplets are fed into hot SCW they heat up and tend to polymerize before they dissolve. See Dabiri (59).

Laboratory research on a very small scale, mostly on a batch basis, suggests that SCW treatment may hold promise for larger scale HCM conversion. However, the laboratory work with continuous processes is also too limited to suggest how to carry out SCW treatment at a viable commercial scale. A three foot tall, lab-scale, continuous reactor to fractionate the bitumen components by dissolving them in hot water before the final reaction temperature is reached using a counter-flow continuous reactor obtained similar products to those from batch reactors. See Fedyaeva (3). A mixture of bitumen and water was also treated in a laboratory stirred tank reactor. See Morimoto (11). A laboratory up-flow reactor reacted a mixture of bitumen and water at 300° C., and because the temperature was too low for extensive reaction to occur it was found that at low yield under laboratory conditions light components could be extracted from the bitumen before they had a chance to polymerize to char. See Vilcaez (14). In further non-commercial work U.S. Pat. No. 6,877,369 B2 suggests the addition of hydrogen or process gas to pretreat bitumen in a SCW reactor.

Deep reactors have been taught for other applications to carry out high temperature and pressure processes on a commercial scale. U.S. Pat. No. 4,564,458 describes oxidizing waste in water using a deep reactor that can provide substantial pressure wherein a central pipe delivers wastewater and oxygen to its bottom; the purified water returns up an annulus and heating by DC electric current initiates the exothermic reaction using the electrical resistance of the water. U.S. Pat. No. 6,877,369 describes a reactor system similar to that in U.S. Pat. No. 4,564,458 to hydro-treat and or hydrocrack heavy oil or other carbonaceous material with process gas in SCW and suggests obtaining heat from exothermic reactions without considering that the hydrogenation and thermal processing of heavy oil is generally known to be endothermic. U.S. Pat. No. 5,932,182 describes using an insulating layer of rock wool with helium as a flowing coolant to insulate the reactor surroundings from the inner fluid-conducting pipes. U.S. Pat. No. 4,792,408 describes a deep well, tubular reactor system that includes a column for water to pass down to a reaction chamber and product to pass up to an exit and combusts a fuel to heat the feed in the reaction chamber.

Electric heaters are used to recover oil from heavy oil wells. U.S. Pat. No. 8,851,170 discloses electric downhole heating by resistance of a conduit. U.S. Pat. No. 8,789,599 teaches increasing well production by use of a radio frequency source connected to a coaxial conductor to radiate energy into the surrounding formation. U.S. Pat. No. 8,365,823 shows heating a reservoir surrounding a well to upgrade heavy oil in-situ using radio frequency or microwave radiation and a catalyst. U.S. Pat. No. 8,807,220 provides a method of producing upgraded hydrocarbons in-situ from a production well. U.S. Pat. No. 7,921,907 discloses an in-situ retort with an electric 3-phase resistance heater method and system for extraction of oil from shale. U.S. Pat. No. 9,181,780 describes heating a layer of tar sand with embedded electric heaters. The heat source for a retort is supplied with power through a metal-oxide insulated cable. U.S. Pat. No. 7,891,421 discloses heating an oil-producing formation around SAGD wells and not the well itself using the tubing of the well for emitting RF energy into the formation. Generally electric resistance heaters in oil fields fail because the resistance wires break or corrode. See McGee (22). U.S. Pat. Nos. 8,408,294 and 8,210,256 reveal electric heaters for oil wells that use a pair of tubes in a concentric arrangement by passing radio frequency (RF) current down an inner tube and up an outer tube.

An extensive body of laboratory research has accumulated that shows both the physical and the chemical properties of SCW that make it an excellent medium for upgrading bitumen. But a practical means to take advantage of these properties have not been shown on a commercially viable scale. Upgrading of bitumen with supercritical water has shown promise in batch laboratory tests. SCW is a good solvent for this conversion. However, this process requires pressure above 220 atmospheres and temperature above 374° C. with reaction time of 10 to 60 minutes. An above-ground reactor to provide these conditions on a commercial scale would have to be very large to provide the residence time to process oil at an economic level, with thick steel walls to confine the pressure at this temperature. It also requires engineering equipment to heat the feed to reaction temperature and cool the products so they can be handled. All of the methods so far described have relied on various external heaters or exothermic reactions to supply the considerable quantity of heat needed to raise a mixture of water and oil to super critical conditions. It is estimated that to electrically heat and treat 1000 bbl oil per day with 2:1 water:oil ratio will require 1 MW of power, even when heat is recycled by heat exchange between the feed and product streams. Most of this lost heat would be transmitted to the surrounding rock. Thus, the magnitude of the heating and cooling requirements is very significant. As a result, it would be a costly process.

Thus, suitable practical processes or apparatus for SCW processing of HCM don't exist. An efficient commercial process should be continuous and provide the right process conditions to efficiently perform the conversion at a high yield and without generation of unwanted by-products. The present invention provides an economical and practical way to carry out SCW upgrading.

BRIEF DESCRIPTION OF THE INVENTION

The present invention upgrades HCM in SCW or other supercritical fluids using a reactor and method that generates and contains high pressures; heats and mixes the feed streams; cools the product stream so it can be handled; and recovers heat in a commercially practical manner while minimizing production of char. This is done by facilitating mass transfer of bitumen as it dissolves in heated water, and carrying out the desired chemical reactions by controlling the temperature and pressure in specified zones of the reactor.

The ability to commercially perform SCW upgrading provides processing that is more efficient than strictly thermal processes such as delayed coking and can give yields of at least 85 and up to 95% or higher of lighter products with less char and without adding hydrogen. The reactor and method of the invention suppresses polymerization of the hydrocarbons during treatment which leads to char. Beneficial hydrogen that comes from the sacrificial formation of char, and to some extent from aromatization and double bond formation in lighter fractions can alternatively be provided by feeding hydrogen or hydrogen precursors with the water mixture. Laboratory experiments fail to accomplish such effects since they typically use ampule-sized samples that suddenly get heated to reaction temperature and cannot suggest what is needed in a commercial process.

The reactor system and method of this invention provide an efficient commercial process that can be continuous and can operate at the right process conditions to efficiently perform the conversion of HCM at a high yield and without generation of unwanted by-products. The SCW Upgrader reactor can be advantageously located underground in a cased well, for example, and can have a smaller diameter than an aboveground reactor. The underground location can reduce the pressure force on the reactor walls making them smaller and thinner. In addition, the reactor can have all the inherent benefits associated with the well casing such as special metallurgy; and easier shipping and installation than a traditional reactor vessel. The reactor of this invention is suitable for economical installation close to the source of heavy oil and can provide lighter products readily shipped by pipeline to a refinery without the need for costly diluents.

Furthermore, the reactor configuration has many equipment and operation advantages. The reactor's long vertical length can provide part of the necessary pressure for the process. Heating to supercritical temperature can be achieved using embedded tubing that forms part of the reactor as a skin-effect heater in the reactor. The upward flowing conversion stream can provide heat for the counter-current flowing input stream while making the cooled conversion stream easier and safer to handle and also reducing the electric heat input to the process. The reactor can also be constructed with no inaccessible internal mechanical parts such as mixers that could fail due to coke deposits. The reactor is also arranged such that any build-up of coke on its walls can be removed by occasionally feeding a mixture of oxygen and water without hydrocarbon, which will oxidize coke and dissolve it.

This invention provides the larger and very deep, preferably continuous reactor that is needed for the SCW upgrading of HCM. This invention provides such a reactor to contain the high pressure and temperature, and to economically heat the feed and cool the product so it can be separated and recovered.

The size and length of the reactor and corresponding method of the present invention mixes the feed droplets while the water is heating, so there is time for mass transfer into solution before the droplet is exposed to higher reacting temperature. This is because the length of the reactor permits the needed variation in temperature profile and pressure along the length of the reactor length to achieve the necessary dissolving before conversion.

Another aspect of this invention provides an economical and practical process and method for the liquefaction of coal into desirable liquid hydrocarbons and feedstocks. This is particularly useful in parts of the world where petroleum is expensive and others have tried to make coal into liquid products by hydrogenation and other methods. In fact, economic coal liquefaction has been an elusive goal for decades.

Accordingly, one aspect of this invention is a continuous-flow pressure vessel reactor system for upgrading high molecular weight hydro-carbonaceous feedstocks by contact with supercritical water. The system comprises at least one outer vessel and at least one inner vessel defining an annulus and a central conduit that both have an elongated axis extending in the longitudinal direction. The annulus provides an input or output channel and the central conduit provide the other of the input channel and output channel. The inlet channel transports a down-flow stream of water and the hydro-carbonaceous feedstock axially over a transport length that extends at least most of the axial length of the input channel and that maintains the water at supercritical critical condition over a portion of the transport length to convert at least a portion of the hydro-carbonaceous feed stock to intermediate components. The input channel has one or more inlets to receive at least one of water and hydro-carbonaceous feedstock and one or more outlets to discharge an intermediate mixture comprising water and intermediate components. The output channel receives at least a portion of the intermediate mixture and transports the intermediate mixture as an up-flow stream over at least most of its axial length to convert intermediate components to lighter components. The output channel has at least one inlet that communicates with at least one outlet of the input channel to receive at least a portion of the intermediate mixture. At least one down-flow outlet discharges at least a portion of the lighter components and water from the input channel into a bottom chamber, defined by the outer vessel that communicates the outlet of the input channel with an inlet of the output channel. A heating element with an extended length is in thermal communication over a majority of the axial length of a least one of the input channel and the output channel to heat at least one of the input mixture and the intermediate mixture. Preferably the electric heating element operates at a frequency of at least 60 Hz so that the electric resistance of the heater is in the range 0.1 to 10 ohms to provide heat through a skin effect. At least one reactor up-flow outlet discharges a hydro-carbonaceous output stream comprising hydro-carbonaceous molecules having a lower average molecular weight than the hydro-carbonaceous feedstock for recovery from the system.

In another aspect of the invention at least a majority of the longitudinal length of the input channel and output channel extend into the earth, preferably in a bore hole and preferably at least 95% of the longitudinal length of the input tube and counter-flow tube extend into the earth.

In another aspect of the invention a heat control material extends partially along the length of at least one of an outer tube and an inner tube that define an electrical heat input zone, and the heat control material varies the heat generated by electrical current.

In another aspect, the invention is a reactor system that extends at least partially into the earth for upgrading high molecular weight hydro-carbonaceous feedstocks by contact with supercritical water. The system comprises a reactor casing that extends at least 130 m into the ground and a pair of concentric tubes comprising an inner tube and an outer tube extending into the reactor casing and fixed with respect to each other to define a heater annulus between the inner and outer tube. An annular channel defined by the inside of the reactor casing and the outside of the outer tube is adapted to receive a down-flow stream comprising the hydro-carbonaceous feedstocks in contact with water. A central flow channel defined by the interior of the inner tube is adapted to receive an up-flow stream comprising at least a portion of the down-flow stream. A bottom chamber defined by the bottom of the well casing communicates the annular channel with the central channel. An electrical power source delivers an electrical current to the inner and the outer tubes to provide electrical resistance heating to at least one of the up-flow stream and the down-flow stream and positioned to create supercritical conditions for water in the down-flow stream. A feed inlet in communication with the annular channel provides the hydro-carbonaceous feed and water to the annular channel. A fluid outlet in communication with the outlet channel recovers a converted hydro-carbonaceous feed from the central channel. A piping arrangement is configured to maintain a pressure in the annular and central channel such that the supercritical conditions for water can be maintained in at least a portion of the down-flow and up-flow streams.

In another aspect, this invention is a method of upgrading hydro-carbonaceous feeds by mixing them with a solvent having a supercritical pressure and temperature. The method combines a hydro-carbonaceous feedstock with a solvent having a supercritical pressure and temperature to provide an input mixture. The input mixture passes into an upper portion of a vertically extended tubular reactor and at least 130 meters downwardly in a down-flow channel of the tubular reactor. The input mixture is heated as it passes downwardly to a temperature above the critical temperature of the solvent and elevated to a pressure above supercritical pressure of the solvent to produce a conversion mixture comprising hydro-carbonaceous molecules having a lower average molecular weight than the hydro-carbonaceous feedstock. The conversion mixture passes from a lower portion of the down-flow channel into an up-flow channel to produce a hydro-carbonaceous output stream comprising hydro-carbonaceous molecules having a lower average molecular weight than the input mixture. Heat is transferred by indirect heat exchange from the conversion mixture in the up-flow channel to the input mixture in the down-flow channel. At least one of the input mixture and the conversion mixture are heated with an electrical heat input source. The method provides a product stream comprising at least a portion of the hydro-carbonaceous output mixture. Preferably the heating is controlled to establish a heating pattern so that a region near the distal end of said tubes provides a residence time of 5 to 60 minutes at a temperature range of 400 to 450° C. to convert a substantial portion of the heavy components of the hydrocarbon into lighter components suitable for transporting in pipelines and producing useful products such as fuel in a refinery.

In a further variation of the above aspect of the invention the solvent is water and the conversion mixture has a temperature in a range of 400 to 450° C. and a pressure in a range of 22 to 35 MPa in the lower portions of the down-flow channel and the up-flow channel. The average combined residence time of the input mixture and the conversion mixture in the reactor is 5 to 60 minutes. Preferably the input mixture enters the down-flow channel at a temperature in a range of 20 to 100° C. and a pressure which when added to the fluid head reaches a range of 20 to 35 MPa at the lowest portion of the reactor.

DEFINITIONS

The term heavy hydro-carbonaceous material (HCM) as used herein refers to material that will not flow by the use of ordinary pumping equipment under ordinary conditions and includes hydrocarbon-containing materials referred to as bitumen, residual oil, tar, oil residues, oil sands, coal and lignite. The constituents of HCM will usually have a molecular weight in a range of from 250 to 6000.

The term "water/oil ratio" is the ratio of any water to any hydrocarbons present in a stream or mixture.

The terms "length of reactor" and "reactor length" refer to the total longitudinal dimension of the flow channels in the reactor through which fluid may flow in an up-flow or down-flow direction. Throughout the specification the length of the reactor will extend in a vertical direction. While it may be possible to orient the length of the reactor horizontally such an orientation is not the most practical and eliminates many of the advantages of this invention, in particular the ability to generate a fluid pressure head along the length of the reactor and to safely contain the pressure and temperature of the contents.

DETAILED DESCRIPTION OF THE INVENTION

Bitumen contains a mixture of hydrocarbons of moderate molecular weight called resins and maltenes plus a significant amount (10 to 50%) of heavier molecules called asphaltenes. It is believed that upgrading with SCW benefits by serving as a good solvent for such organic molecules as it is heated toward critical temperature so that the resins and maltenes gradually go into solution before critical temperature is reached, and even asphaltenes can dissolve in SCW before they have a chance to react chemically.

Figure 2:
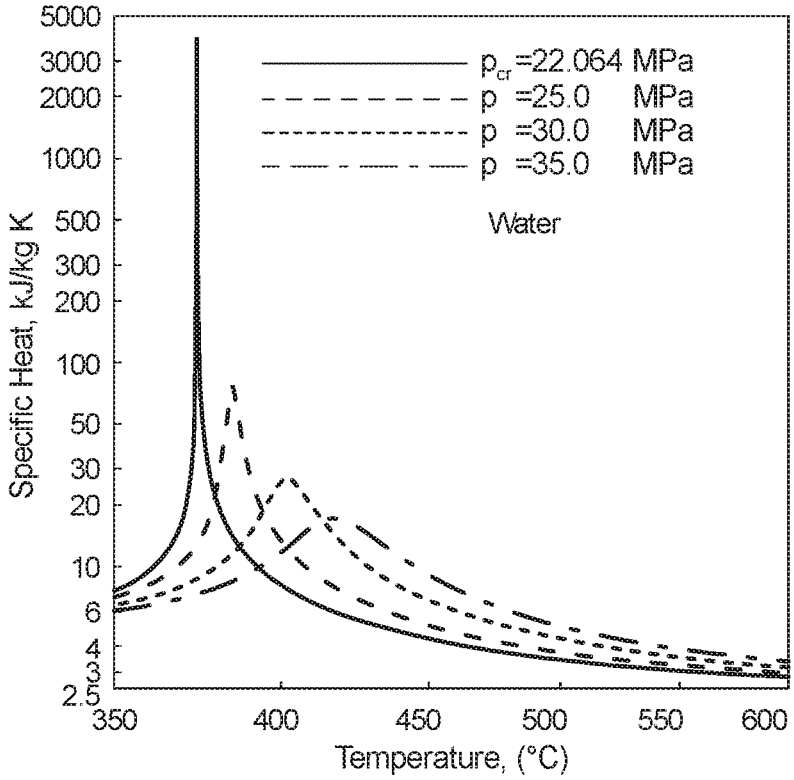
FIG. 2 is a graph of the heat capacity of water showing how it peaks over the critical region.
Figure 4:
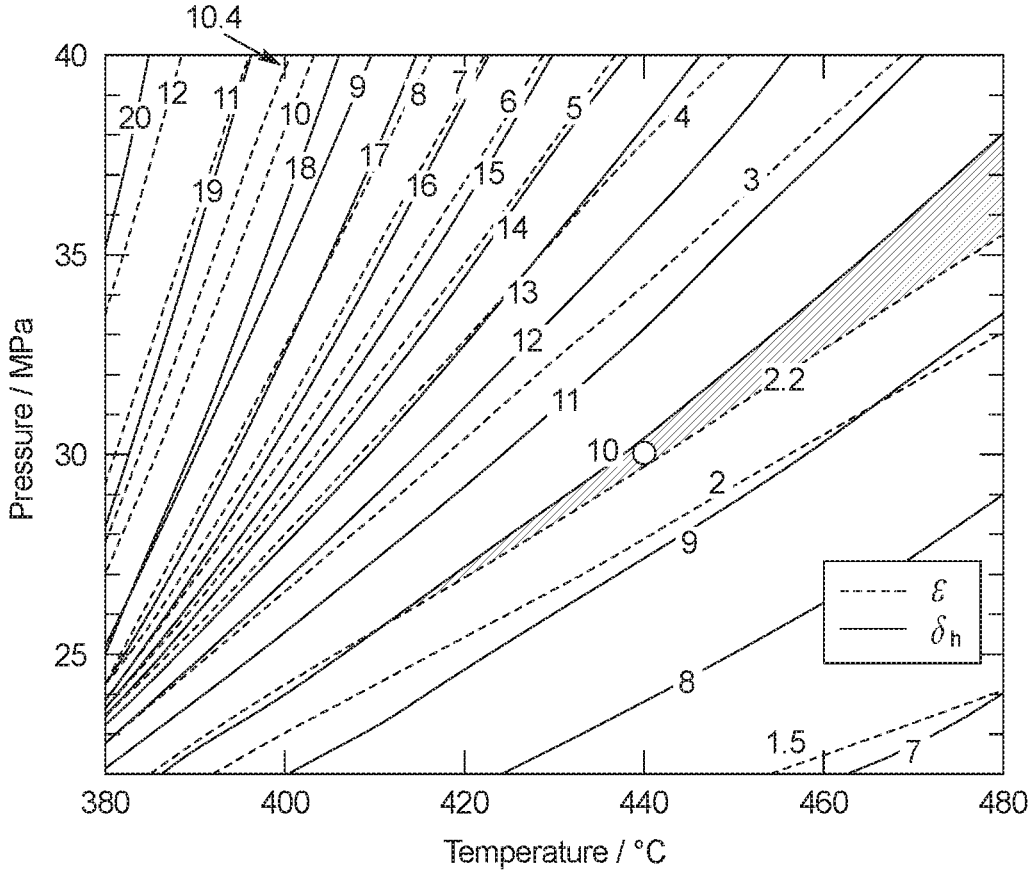
FIG. 4 shows temperature and pressure effects on the solubility of asphaltenes in SCW.

The critical temperature of water is 374° C. and the critical pressure is 22 MPa, where water becomes a lighter fluid. When a higher pressure of 30 MPa is applied, the critical transition occurs more gradually around 440° C. as shown in FIG. 2. Investigators have found in laboratory tests that the shaded region in FIG. 4 gives the best upgrading. This is because asphaltenes are completely soluble in this region, so long as they have not had time to polymerize. The reaction time is longer at the lower temperatures during heat-up, and therefore reaction is low, but mixing and dissolving is rapid which prevents polymerization of the asphaltenes.

Near the critical temperature of water asphaltenes and other HCMs begin to crack, splitting off lighter radicals that can combine and polymerize to form heavier molecules, and eventually produce char. Radicals can dissolve in SCW and in solution are separated by water molecules. Separation retards polymerization and reduces char formation. Instead, these radicals can abstract hydrogen from other molecules in solution and can cap the bonds in radicals to form stable, moderate molecular weight compounds. These moderate weight compounds are suitable feedstock for refining into gasoline, diesel fuel and other chemical processes.

When HCM molecules such as resins and asphaltenes give up hydrogen they can form olefins, and some form aromatic compounds as described by Song (19). The specifications for gasoline and diesel permit some portion of these compounds. For example, gasoline may contain up to 18% olefins (AMF 20), and diesel fuel may contain aromatics.

Addition of hydrogen to the feed will produce more saturated products. Hydrogen can be in the form of gas or precursors such as carbon monoxide or formaldehyde or even organic wastes or cellulose that can react with water to produce hydrogen.

One aspect of the invention involves the ability to remove light products from droplets into the heated water phase. See Wu (60). As it is heated the drop initially expands due to water dissolving in the oil phase, and dissolved water may reduce the droplet's viscosity and aid mass transfer to stimulate extraction of product compounds.

Figure 1:
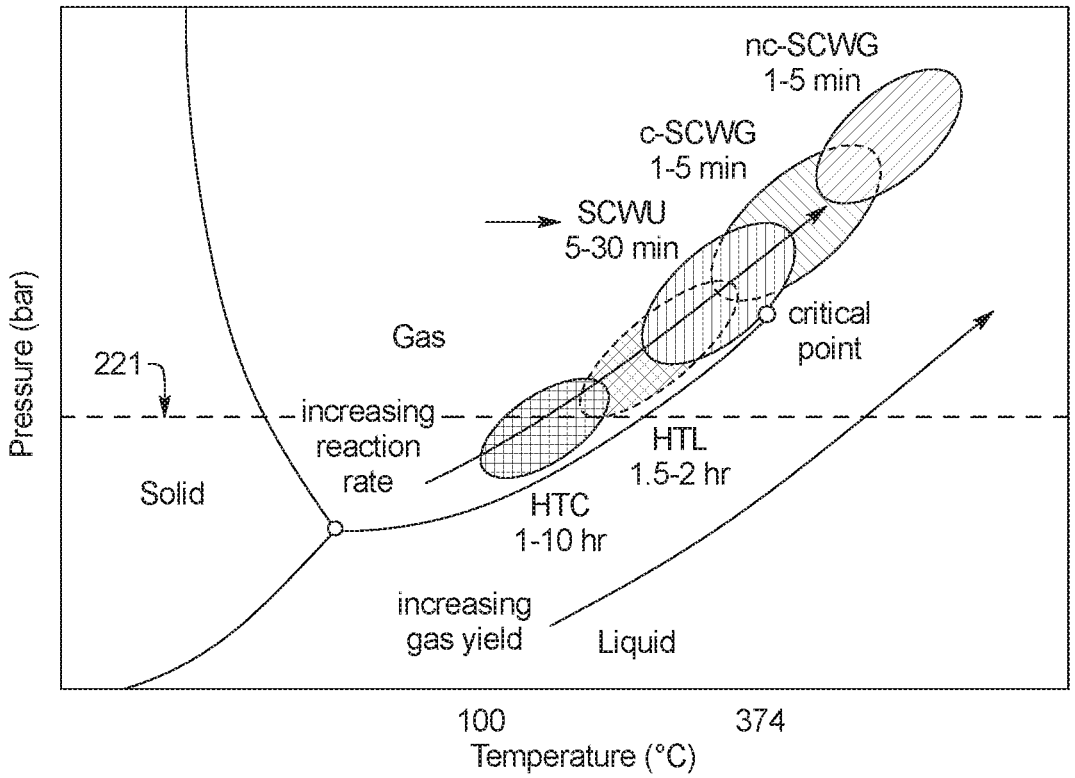
FIG. 1 is a graph showing the phase behavior of water and several regimes for hot water treatment.

FIG. 1 is a graph that shows the phase behavior of water in different high temperature water treatments with several regimes of hot water treatment superimposed thereon See Timko (13). Water is a gas (steam) at pressures below its critical pressure and a liquid at pressures above it. At the critical point, liquid and gas become one phase. In FIG. 1 HTC refers to hydrothermal carbonization, HTL refers to hydrothermal liquefaction, SCWU refers to supercritical water upgrading, c-SCWG refers to catalytic supercritical water gasification and nc-SCWG refers to non-catalytic supercritical water gasification. The time required for chemical reactions is shown as hours for the lower temperatures and minutes for the higher ones. At or near the critical temperature of 374° C. upgrading can occur in the region denoted by SCWU.

Many properties are affected by temperature, but two stand out. Two significantly affected properties are the ionic dissociation constant of water, which precipitously drops at the critical temperature, and the dielectric constant, which drops steeply from room temperature to the critical temperature. In addition, as shown in FIG. 2 the peak of the heat capacity shifts with increasing pressure above critical. This behavior, shown by dashed lines at higher pressures, is called pseudo-critical.

Even for the mildest of the hot water processes shown in FIG. 1, the solvent and ionization properties of water differ substantially from those at room temperature. The lower dielectric constant means that hot water loses its polarity and behaves more like an organic solvent and can therefore more readily extract oily components. The increased ionic dissociation constant leads to an increasing $[H^3O^+]$ concentration and thus promotes reactions requiring the addition of an acid, or acid/base catalysis or that proceeds via highly polar transition states. See Caniaz (1). Increasing temperature increases reaction rates, and the zone designated as SCWU in FIG. 1 is centered on the critical transition region of these reaction conditions.

The properties of supercritical water can enhance chemical reactions, especially those leading to lower molecular weight products. In particular diffusion rates are high and viscosity is low in a supercritical aqueous mixture. These transport properties and miscibility influence the rate of chemical reactions, especially when a HCM phase has to mix with the water to get its beneficial effects. High diffusion rates and low viscosity, together with the complete miscibility with many substances makes supercritical water an excellent medium for homogeneous, fast and efficient reactions.

It is believed that dissolving HCM components in SCW slows pyrolysis reactions that lead to polymerization and char formation by a "cage effect" caused by the structure of water molecules near critical conditions. Because of the cage effect, the collision frequency of the reactant with water is much higher than with another molecule of the HCM. Therefore, bimolecular HCM reaction rates are decreased and char formation through polymerization is reduced.

Supercritical fluids (SCFs) are known to: combine properties of gasses and liquids into gas-like viscosity and liquid-like density; dissolve organic solutes like a liquid; speed up reaction kinetics and mass transfer, allow improvement of solvent properties by manipulation of temperature and pressure; and dissolve gaseous species in the fluid phase which may lead to higher gas reaction rates.

FIG. 1 shows a continuous flow reactor for upgrading HCM by formation of hydrocarbon droplets that mix with water at low to moderate temperature as it heats from 20 to 100° C. up to 374° C. for sufficient time of 5 to 30 minutes.

for the water to extract lighter components and radicals from the droplet. To avoid char formation the residence time during this heating period is small compared with the hours-long reaction time shown for HTC and HTL on FIG. 1. For continuous flow the velocity to achieve this residence time may be in the range of 3 to 300 m/min Further heating raises the mixture of water and HCM components to the supercritical region. The mixture will be kept at these conditions long enough to carry out the upgrading reaction, typically for an average residence time of 5 to 60 minutes. As the fluid mixture leaves the hot reaction zone, cooling by heat transfer can cause further extraction of light pyrolysis products and radicals and prevent further polymerization and char formation to increase product recovery. The following laboratory investigations further explain the chemical and physical transformations observed in batch reactors, which this invention produces on a continuous production scale.

Figure 3:
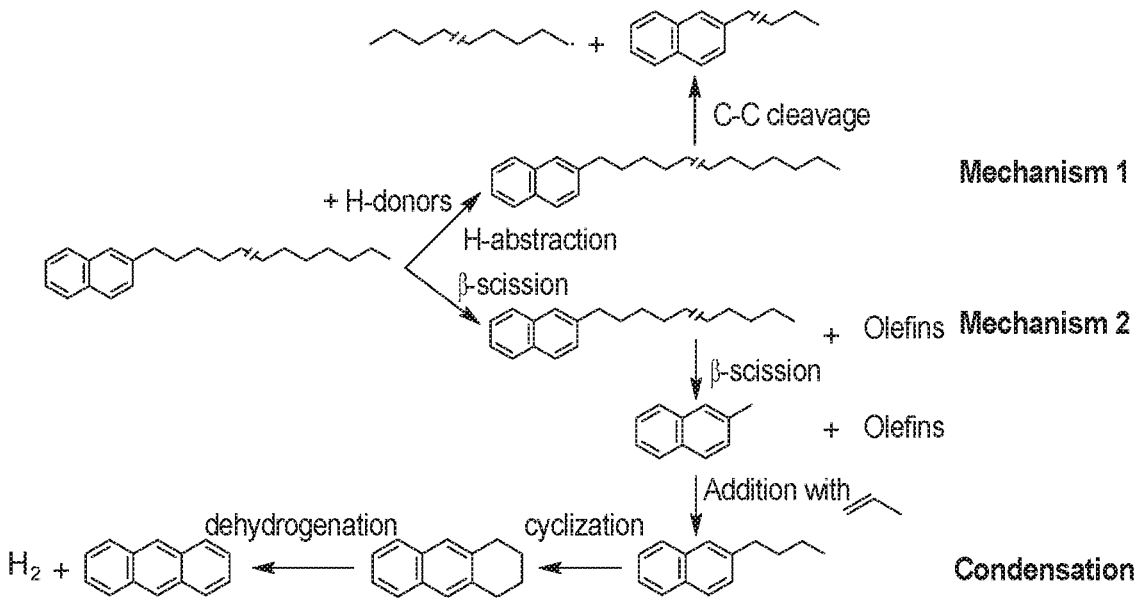
FIG. 3 schematically represents reaction mechanisms of asphaltenes in upgrading HCM.

FIG. 3 shows the reaction mechanisms believed to lead from asphaltenes to either light products or coke. See Liu (8). Asphaltenes consist of aromatic rings held together by hydrocarbon chains and are represented in simplified form on the left side of FIG. 3. The aliphatic chains bridging the condensed aromatic rings of asphaltenes and resins first break, to release aromatic radicals with relatively long aliphatic substituents shown on the left side of 3. This chain-breaking process continues in one of two competitive mechanisms as shown in FIG. 3.

In mechanism 1 the aromatic radicals are then saturated by abstracting hydrogen from other H donors. Further C—C cleavage of substituent aliphatic chains leaves smaller desired aromatic and saturated products. Competing mechanism 2 repeatedly shortens the aliphatic substituent chains on the aromatic radicals through mono-molecular β-scission to produce methylated aromatics and short olefins. The activation energy of H-abstraction is about 40 kJ/mol, and that of β-scission is 120 kJ/mol and requires higher temperature. Mechanism 1 can occur at temperatures below the critical temperature and in the SCW phase. Mechanism 2 results in char if reaction conditions are not controlled carefully.

Another aspect of this invention is control of the flow rate and heating rate to hold the mixture for a sufficient time to maximize yield and minimize char formation. Water concentration is an important factor on the phase behavior and location of aromatic radicals. At the lowest water content (1 part water to 2 to 4 parts oil) separate oil and water phases appear and it is believed that the high viscosity of the HCM prevents radicals from leaving and favors the β-scission that leads to coke. See Liu (8). At higher water/oil ratios, at least 1 to 1 and preferably 2 water to 1 oil it has been found that the oil eventually completely dissolves in the water phase, so aromatic radicals can diffuse into the water phase and be saturated with hydrogen from H donors, leading to liquid products rather than coke. It is believed that at even higher water levels, this trend should be more favorable.

In another aspect, this invention controls the temperature and pressure and may do so by controlling heating rate and pressure as shown in several batch experiments. The degradation/extraction of asphaltene in a batch reactor found good results at 440° C. and 30 MPa pressure with a water/oil ratio about 2/1. See Morimoto (9, 11). For bitumen reaction conditions of 420° C. with a water/oil ratio of 2.5 to 1 a reaction time of 30 minutes produced good results. See Vilcaez (14). Treating vacuum residuum (a residue from oil refining containing asphaltenes like bitumen) for 1 hr at 420° C. and 2/1 water oil ratio gave good results with a yield of 83% and coke formation only 3.6%. See Cheng (2) and Zhao (21). Similar attempted conversions but for 3 hr. at 380° C. found coke formation 49%. See Kozhevnikov (5). Thus, it can be concluded from these and other batch experiments that with a water/oil ratio at least 1/1, a reaction temperature about 400 to 450° C. and a pressure about 25 to 35 MPa good results can be produced with yields from 85 to 95%, but lower ranges of these three variables are less satisfactory.

Dissolving asphaltenes in water requires special conditions. There are a number of good room temperature solvents for asphaltenes, ranging from 1,2dichloroethane to benzene, that provide insight into the conditions needed for SCW to dissolve asphaltenes. See Morimoto (10). Good solvents are characterized by their moderate dielectric constant and values of three other Hansen solubility parameters such as aromaticity and hydrogen bonding. Applying these criteria to water is believed to reveal the conditions where water provides similar values of these properties. FIG. 4 provides dielectric constant ε and HSP hydrogen bonding component $\delta_h$ of SCW and shows how these properties vary with temperature and pressure of water. The preferred values are found in the shaded region in FIG. 4. As indicated, SCW has been found in this region to have the necessary properties to completely dissolve asphaltene. It is believed that solubility governs upgrading as confirmed by supporting batch experiments at 440° C. as shown by a circle on the graph of FIG. 4 at 440° C. and 30 MPa.

Furthermore, conversion of a vacuum residuum containing 14% asphaltenes by SCW has shown a good yield of light products when conducted at 420° C., water to oil ratio of 4:1, and pressure 25 to 27 MPa for a time of about 3 minutes. Raising the temperature to 460° C. gave more coke. See Cheng (2).

Morimoto (10) measured an optimum yield of 85% at 40 minutes and 450° C. This included heat-up time of about 10 minutes and the most of the remaining time at constant temperature. In additional experiments they concluded that 440° C. was optimum. So the best results are obtained in approximately 30 minutes at 420 to 440° C. at pressure 26 to 30 MPa. The time may be less in a reactor with better mass transfer such as a continuous flow reactor as described herein.

Description of Preferred Reactor Arrangement

Figure 5:
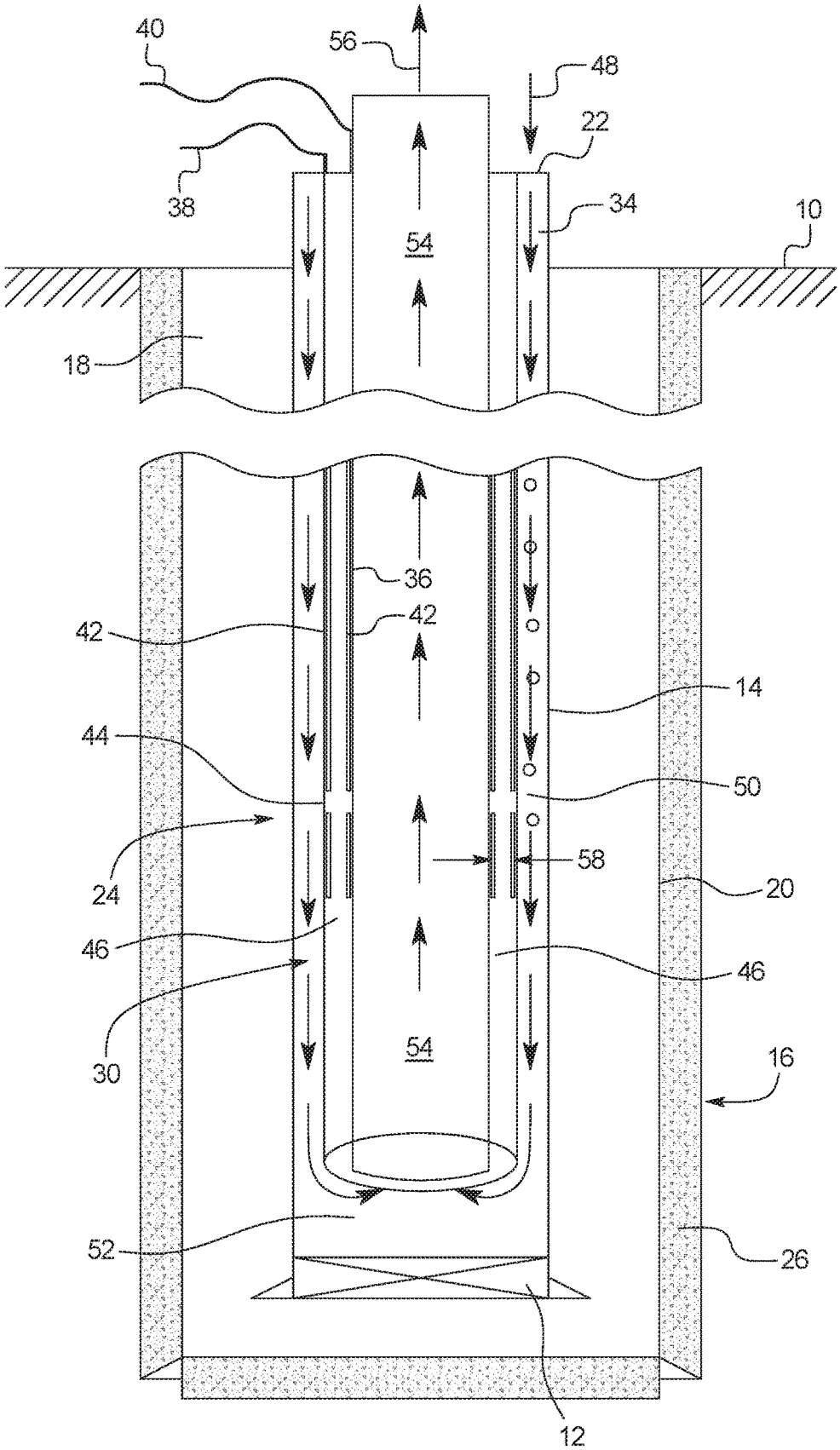
FIG. 5 shows portion of a reactor of this invention constructed in a borehole.

In the reactor arrangement of FIG. 5 a reactor casing 14 of a reactor 24 extends downwardly from ground level 10 into well 16 having an outer well casing 20. There is no inherent limitation on the size of the well casing and such casings may be 24 inches or larger; however, in most instances the well casing will have a diameter of from 10 to 12 inches, although a pilot unit may be smaller Reactor casing 14 is a tubular conduit that serves as an outer vessel wall of reactor 24 and has sealed bottom 12 and sealed top 22 to contain pressure in the vessel.

The reactor vessel may be thermally insulated by thermal insulation 18 to limit heat loss from reactor casing 14 to the surrounding formation 26 that will typically comprise soil or rock. A layer of highly effective insulation can greatly reduce the heat loss to the rock. For example, Thermal insulation 18, when provided, typically fills an annulus 28 defined between the inside of outer well casing 20 and the outside of reactor casing 14. The insulation material may be any insulating material that can be placed into the annulus, has insulating properties, and will remain intact for long periods of time. In particular, the insulating material may be subject to cycles of mechanically induced stress by expansion associated with the elevated temperature and/or elevated pressure of the reactor 24. Suitable insulating materials include rock wool, expanded perlite or fly ash combined with cement.

A highly effective insulation is Silica Aerogel that is a form of expanded silica particles containing microbubbles of air. It is available in the form of blankets from 8 mm to 25 mm thick, with a thermal conductivity only 0.023, compared to rock with 2 to 10 or more W/m-° K. It can be attached to the outside of the reactor casing 14.

Typically, providing an insulating material will preclude the vessel obtaining any support from the surrounding rock. In such cases casing 14 of any similar vessel wall must be designed with sufficient strength to independently resist the internal pressure.

In the preferred form of the reactor as shown in FIG. 5 a feed stream 48 enters an annular channel 50 through one or more openings (not shown) in sealed top 22. A bottom chamber 52 communicates annular channel 50 with a central channel 54. The feed stream 48 passes down annular channel 50 as a down-flow stream 51. Bottom chamber 54 redirects the content of the annular channel into central channel 54 as an up-flow stream 53. Passage of the feed stream 48 through annular channel 50, bottom chamber 54 and central channel 54 converts it to a conversion stream 56. An outlet (not shown) recovers conversion stream 56 from the top of central channel 54.

In its usual vertical configuration the reactor will have a length so that fluid head can provide a substantial portion of the pressure required for the reaction. Reactor length will typically be at least 130 m, preferably at least 150 m and usually in a range of 150 m to 1000 m or more. In terms of pressure, the length of the reactor will typically provide enough height to provide a head of fluid pressure of at least 4 MPa, more typically at 5 MPa and preferably at least 6 MPa.

The top end of annular channel 50 and/or central channel 54 may be below ground level, be positioned at ground level; or may extend above ground level. In the preferred form, annular channel 50 and central channel 54 will extend at most only slightly above ground level (as shown in FIG. 5.)

Keeping most of the reactor in the ground can make the reactor and its operation inherently safer. The borehole will typically be lined with an additional casing 20 cemented into the surrounding rock, providing additional safety containment and protection of groundwater.

The diameter of the reactor casing will usually range from 6 to 18 inches and preferably from 10 to 12. The diameter of reactor casing limits the diameter of the central channel, which in turn determines its flow area. In most cases the flow area of the central channel is in a ratio of 0.5 to 4 and is preferably double that of the annular channel.

In the preferred form of this invention the reactor casing 14 surrounds an electrical heater assembly 30 that provides a partition 58 defining the inner wall of annular channel 50 and the outer wall of central channel 54. Preferably heater assembly 30 comprises an outer heater tube 32 that concentrically surrounds an inner heater tube 34. Electrical leads 38 and 40 conduct electrical current to the outer and inner heater tubes, respectively and are electrically connected at their distal end typically by a sliding contactor. The inner tube 34 is typically connected to the positive terminal of a power source, and the outer tube to the negative or ground terminal. A heater annulus 46 separates the inner tube 36 and from outer tube 34. The heater annulus 46 is usually sealed and filled with a packer of a type known in the art. Alternatively the contactor and packer may be replaced by a metal cover welded to the distal ends of the heater tubes and sealing the heater annular space. (not shown).

The heating rate is increased by the skin effect of the tubing, which causes the current to flow in a thin surface layer and increases the electric resistance. The skin effect depends on a combination of the frequency and magnitude of the electric current and the material properties including the resistivity and magnetic permittivity of the tubes. See U.S. Pat. Nos. 8,408,294 and 8,210,256.

In operation the heating rate is chosen to set the desired production rate. The heating rate depends on the length of the tubes, the resistance per meter and the current. Standard API carbon steel tubes do not have enough electrical resistance to produce sufficient heating for most purposes using low frequencies, but at frequencies above 60 Hz the magnetic effect in such steel tubes causes the current to flow in a thin surface skin which therefore has a high resistance, so the desired heating of the well can be accomplished. By choosing the material and the frequency the heating rate can be fitted to the requirements. For applications where the length is shorter than 100 m, a radio frequency greater than 1000 Hz may be required, while a longer heater may suffice with a frequency as low as 60 Hz. For example, a resistance of around one ohm will give a current of a few hundred amps at a few hundred volts applied voltage. (Resistance means the real part of the complex impedance.)

To further adjust the regions of heat input the inner and outer heater tubes can be clad with materials having different properties that may be used to limit heating in zones where heating is not needed. FIG. 5 shows this material as cladding 42. The cladding may be discontinuous and separated by one or more spacers 44 that may comprise spaces between separate sections of the cladding 44. Suitable cladding materials comprise aluminum or copper. A preferred cladding material is non-magnetic aluminum. The addition of a layer of aluminum will mostly eliminate heating due to the lower electrical resistance and non-magnetic property of aluminum relative to the tube metallurgy. Both inner and outer tubes are described as being clad, although in the case of the outer tube this actually refers to a lining.

In one aspect of this invention the reactor typically has three zones: an upper heat exchange zone, a middle heating zone, and a lower reaction zone. Heat input to the reactor may be configured to serve the heat requirements for each zone by altering the electrical properties of heater assembly 30. In other aspects of this invention the length of the upper heat exchange zone, middle heating zone and lower reaction zone are varied to maximize production and yield, as well as the heat recovery.

The up-flow stream 54 is typically hotter than the feed stream 48 over the whole reactor length. Therefore, in the upper heat exchange zone the up-flow stream can heat the downstream over its entire path down the annular channel 50 by some degree of heat exchange across the heater annulus partition 58. Primarily the upper third to half of the reactor length is designed to heat the down-flow stream by heat exchange from the up-flow stream. The conversion stream 56 is thereby cooled to facilitate handling in surface equipment. Because of the cladding in this portion the down-flow stream is heated only by heat flow from the up-flow stream. The heater annulus 46 may be filled with a gas or thermally stable oil to facilitate heat transfer between the inner and outer heater tubes and across the partition 58.

The length and thickness of annular flow channel 50 is selected to cause droplets of the HCM to mix with the water by laminar flow shear against the walls of channel 50 as the mixture flows downwardly, especially in the upper heat exchange zone. This zone will have a length of one third to one half the reactor length, therefore 60 to 1000 meters. In the upper heat exchange zone HCM components with boiling points below asphaltenes (called maltenes) are typically extracted into the water before they have time to polymerize to form char. The upper heat exchange zone provides the effective mixing of the HCM with heated water in the annulus required to heat the droplets in a manner to avoid forming char.

The reactor is configured to recover heat from the product stream in the inner tube 54 into the feed stream in the annular flow channel 50. By cladding the inner tube in the proximate third or half with a layer of aluminum (inside the heater annulus) electrical heating is mostly eliminated due to the lower electrical resistance of aluminum, but heat transfer raises the feed stream temperature in the channel 50. Recovering the heat energy in this way minimizes the electric power requirement. It also lowers the temperature of the upward-flowing product stream, terminating the chemical reactions and making the product easier and safer to handle as it reaches the surface facilities. The pressure is also partly reduced by the diminishing head as the fluid rises, and is controlled by a back-pressure regulator valve 100 at the exit. At the surface, the product stream may be further cooled in an external heat exchanger 86 against the feed stream 88 or other means. (See FIG. 6.) However, this external heat exchanger is optional.

Mixing in the upper heat exchange zone is typically accomplished by maintaining annular flow channel 50 as a relatively thin annulus that assures fluid shear against its annulus walls. The width of the annular flow channel is typically in a range of 0.25 to 2 inches and preferably in a range of 0.5 to 1. inches. When the relatively cold feed stream 48, typically at a temperature of 20 to 90° C., is introduced at the inlet 22, the HCM will have a high viscosity, typically ranging from as much as 50,000 to 100,000 centipoise. The bitumen may adhere to the walls and accumulate locally to form slugs. Water acting against a slug will force the HCM down the annulus to the middle heating zone. The feed pump can provide sufficient pressure to overcome any resistance of HCM slugs. In the case of bitumen, the viscosity falls by a factor of ten for every 15° C. temperature rise. As HCM adhering to the wall is heated and displaced it becomes entrained toward the middle of the annulus or may flow in heated layers. This causes fluid shear to spread HCM slugs out as they travel down the length of the reactor thereby exposing more surface area of the HCM to the water which can then flow by, so that HCM components dissolve. The flow of HCM adjacent the wall will be laminar because of its high viscosity. The transition between laminar and turbulent flow depends on the Reynolds number $Re=Dv\rho/\mu$, where D=effective diameter of the flow passage, v=velocity, $\rho$=fluid density and $\mu$=fluid viscosity. Flow is generally turbulent above Re=2000. The water flow in the middle of the annular channel will be turbulent because its viscosity is low, which will cause stirring between the two phases.

The process of mixing gets enhanced as the HCM moves down the reactor length and gets more heated so that it flows more readily. The long length of the reactor overcomes the nature of the mixing, which is slow especially at the proximate end where the feed stream enters the reactor. The reactor length is selected to provide ample opportunity for HCM and water to mix as it is heated. Thus, the upper heat exchange zone and the middle heating zone will usually have a collective length in a range of 50 to 1000 m.

To further improve mixing, instead of feeding raw HCM with water into the reactor, it may be preferable where possible to first mix the HCM into an emulsion and feed the emulsion. This additionally assures that droplets are formed with a high surface area to promote dissolving of HCM components as the water is heated in the annular flow channel 50. The forming of such emulsions is taught in U.S. Pat. Nos. 6,602,917 and 5,851,430. The feed water and bitumen may be preheated prior to mixing and forming the emulsion by heating, preferably by heat exchange, and more preferably with heat from the conversion stream.

The middle heating zone comprises a mid-portion of the reactor length, typically a length approximating the middle third of the reactor. The middle heating zone primarily heats the feed stream by the heat input, typically via an arrangement like that of heater assembly 30. Heating in this zone will raise the temperature of the down-flow stream to the desired temperature range for the conversion of the HCM by the SCW.

The lower reaction zone comprises the remaining portion of the reactor length and in many cases will take up the bottom quarter to one third of the reactor length. The lower reaction zone typically functions as the primary region where the conversion reactions of the HCM take place. Over the length of reaction zone the down-flow and up-flow streams are maintained at about the desired temperature for the conversion of the HCM with the SCW.

In another aspect of this invention the lower reaction zone is configured to provide sufficient time in the desired temperature to complete the upgrading reactions which convert most of the HCM to lighter products. The extent of cracking and the yield of lighter products is determined by the reaction time, which is the time spent by the fluid in the lower reaction zone. The time in the lower reaction zone is usually in a range of from 5 to 60 minutes and preferably in a range of 10 to 30. The residence time of the streams in the lower reaction zone can be adjusted by varying one or more of the flow rate; the flow area of the annular and/or central channel, and the temperature set at the distal end of the lower reactor zone. The residence time will also be affected by the effectiveness of the thermal insulation which controls heat loss from the reactor. Residence time may also be adjusted by the addition of diluents or solvents; however, in most cases this is not preferred since it will require additional above-ground processing to remove or recover such fluids.

Additional heat input, typically by a lower portion of the heater assembly 30, holds both the down-flow and up-flow stream streams at the desired temperature typically in a range of 400 to 450 and preferably in a range of 420 to 440° C.

One aspect of this invention dissolves asphaltenes that comprise or are generated from the HCM in the SCW before they have time to polymerize. Asphaltenes, especially in the form of oil droplets, can polymerize to form undesirable char, or if first dissolved in SCW can decompose to form desirable light products. As the feed mixture flows into the mid heating and reaction zones, it is exposed to the unlined heater tubes, where the skin effect maximizes the heating by the tubes. Within the reaction zone temperatures at or above critical are reached at which water begins to dissolve asphaltenes.

At SCW temperatures above 374° C. pyrolysis reactions also begin. The reactions break off lighter fragments which can dissolve in the water and form radicals. The radicals that dissolve are shielded from polymerizing by the water molecules cage effect and their open bonds are capped by hydrogen abstracted from previously dissolved components.

On the other hand, the radicals left in the not yet dissolved HCM droplets can react with other HCM molecules to form polymers and eventually crack to form char.

There is a competition between dissolving and polymerizing and both rates increase with temperature, but dissolving is also aided by mixing. Accordingly, another aspect of this invention promotes getting the various hydrocarbon molecules that may form char into solution, especially asphaltenes. The water temperature becomes supercritical in the lower part of the middle heating zone where asphaltene can dissolve in SCW, limiting polymerization which leads to char. Although in SCW solution asphaltene can crack to form lighter molecules, water largely shields the resulting molecules from polymerizing. These cracking reactions have an activation energy of 120 KJ/mol as shown in FIG. 3; are strongly temperature dependent; and are limited in extent before the supercritical temperature is reached. Reaction times of 5 to 60 minutes have been measured at temperatures from 400 to 440° C.

In another aspect, this invention moves this competition toward dissolving asphaltene content by promoting mixing especially through the use of a long reactor length that provides ample opportunity for mixing by shear as the down-flow stream interacts with the walls of the annular flow channel 50. This behavior overcomes the mass transfer problems that led to char formation in some laboratory batch experiments. Nevertheless, forming a small amount of char can advantageously trap heavy metals, sulfur, nitrogen and other impurities and thereby improve the properties of the light products obtained by this invention.

Another aspect of this invention provides a reaction zone where the temperature is above 374° C. FIG. 1 shows that cracking reactions begin slowly at temperatures below the critical point.

In another aspect of this invention the dissolving and reacting of asphaltene takes place at a temperature of 420 to 440° C. Such higher temperature in the lower reaction zone may speed the upgrading reactions. Such temperatures continue into the up-flow zone in the inner tube flow passage 54.

As the up-flow stream enters the middle heating zone it is still heated to maintain its temperature, typically by a heater assembly 30. The up-flow stream typically enters the middle heating zone at a higher temperature than the adjacent down-flow stream. To prevent excessive heating of the up-flow stream the inner tube may be clad with aluminum. Heat exchange across the heater assembly cools the up-flow stream by transferring heat to the down-flow stream.

Pressure has a large effect on the critical behavior of water and in other aspects of this invention determines the effect of the water environment. FIG. 2 and the previous description thereof show the behavior of water around the critical region. Referring again to FIG. 2, the critical temperature is 374° C. at 22.1 mPa. At 25 MPa there is a transition shown by a peak at 387° C. at a pseudo-critical point at 25 mPa. As shown by FIG. 2 the invention may maintain the maximum pressure in the lower portion of the lower reaction zone in a range of 25 to 35 MPa to achieve conversions depicted by FIG. 4 in the reaction zone. The maximum pressure in the lower reaction zone will vary down its length as a result of the pressure head of the fluid. Accordingly, the heat input to the lower reaction zone may be adjusted to provide a desired conversion temperature at different locations along its length to maximize the conversion through the zone. For example, if a backpressure regulator for the top of the annular channel is set so that the pressure at the distal end of the reactor is 30 MPa, then at some distance above the distal end there will be less head of fluid acting and the pressure may be 27 MPa and the temperature may be set at 420° C. for that location to maximize the conversion. The pressure in reactor 24 is generated by the feed pump 41 which is set to deliver a specified feed rate. The pressure in the reactor is controlled by the back-pressure regulator valve 100 at the exit of the central channel 56.

Figure 6:
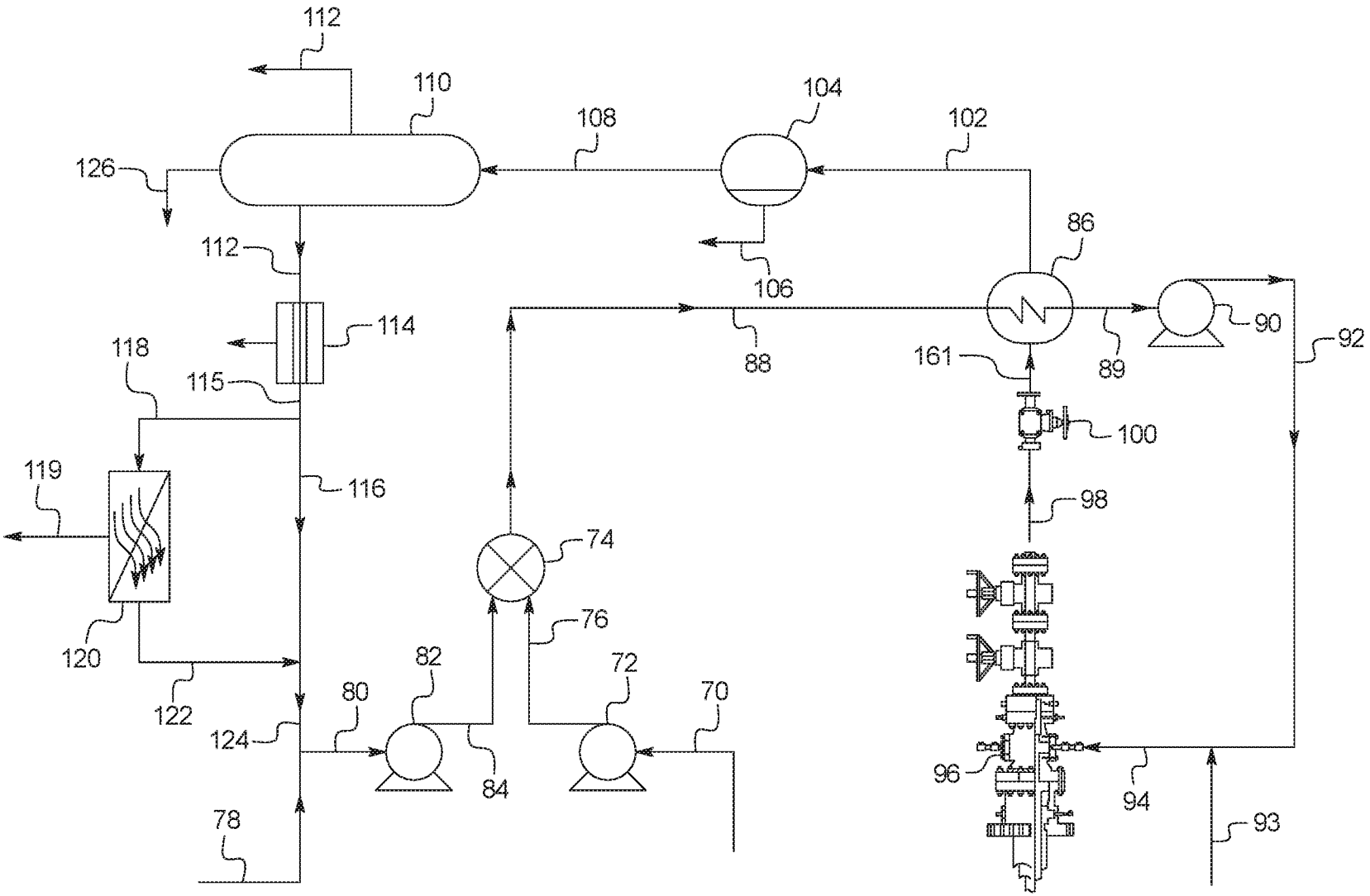
FIG. 6 is a flowsheet showing an arrangement for equipment located on the surface for a reactor of this invention.

FIG. 6 shows one possible arrangement for delivering an HCM feed stock as feed stream 48 to a reactor of this invention and recovering product stream from a conversion stream 56 flowing out of a reactor of this invention. The equipment and arrangement thereof presents only one of numerous arrangements for such equipment and is not meant to limit the invention to the particular arrangement shown in FIG. 6.

Looking then at the flow of feed in FIG. 6 a feed pump 72 delivers, via lines 70 and 74, an HCM containing feed stock to a mixer 74 that also receives a water input stream via a line 84, a pump 82, a line 80 and a line 78. Mixer 74 mixes the water and feed stock into a feed mixture, preferably in the form of an emulsion and passes the mixture to a heat exchanger 86 via a line 88. A line 89 transfers the heated feed mixture to an injection pump that raises the pressure of the feed mixture to the desired inlet pressure for the reactor and transfers the feed mixture via a line 92 to an optional hydrogen addition line 93 to a well head valve assembly 96 via a line 94.

Well head assembly 96 communicates the resulting feed stream from line 94 to a reactor arrangement of this invention and recovers the conversion stream produced by a reactor of this invention. The well head assembly represents one possible configuration for the supply and recovery of fluids from the reactor of this invention.

Turning then to product recovery, a conversion stream 98 flows via a line 98 to a pressure regulator in the form of valve 100 that discharges a low pressure conversion stream into heat exchanger 86 via line 101. Following heat transfer to feed mixture in heat exchanger 86, the cooled conversion stream flows via line 102 to a solids separator 104. Solids separator 104 removes a majority of the char from the cooled conversion stream. A line 106 recovers char from separator 104 for other possible uses. One such use is in a char-fed power plant to provide energy input to the process of this invention. Line 108 passes a purified stream to a separator 110 that separates the purified stream into a gas stream that goes to a flare or preferably a recovery zone to recover the heat value of the gas stream. Phase separation of the water from the hydrocarbon components yields a product stream recovered via a line 126 and a water phase taken by a line 112. The product stream will comprise light oil that is suitable for transfer to a pipeline.

The water phase stream carried by line 112 typically undergoes further processing for reuse in the reactor of this invention. FIG. 6 shows the water stream passing through a purification filter 114 for the removal of residual char and any other particulates that may be present in the separated water phase. The water phase carried via line 115 is divided into a side stream 118 and a transfer stream taken by a line 116. Side stream 118 goes to an additional purification zone 120 that rejects salts and other impurities from water phase via a line 119. A line 124 combines the purified water from a line 122 with transfer water from line 116 to provide a water recycle stream for recycle via line 80 to provide water to the reactor of this invention. Purification zone 120 removes impurities from the water phase to keep the equilibrium level of such impurities in the recycle water at a desired level.

In a preferred arrangement of the process and system of this invention, feed pumps supply a selected flow rate to the system at the pressure prevailing at the proximate end of the reactor. This pressure is the same at both feed stream input point 94 and the conversion stream recovery point 98 except for a small pressure drop due to the flow resistance in the reactor passages and a slight difference in the density in the feed and product flow channels due to the temperature and composition differences in these channels. As shown in FIG. 6, pressure is typically controlled by a back-pressure regulator 100 at or near the discharge 14 of the reactor. The fluid head at the bottom of the reactor will add to the regulator pressure and determine the pressure in the reaction zone. The fluid head is determined by the average density of the water and the HCM as it heats along the length and gets converted to lighter product hydrocarbons.

In a specific embodiment of this invention water enters at 90° C. from a heat exchanger. Based on the properties of water varying with temperature in an annular channel, the average change of density of a down-flow stream, vary from 0.95 g/cm3 at 90° C. to 0.17 g/cm$^3$ at critical conditions and can be calculated to be 0.63 g/cm$^3$. For example, the head at the bottom of the annulus in a 1000 m long reactor is 1000 m×0.63/(10.5 mbar×10 bar/MPa)=6.0 MPa. Then to reach 30 MPa at the bottom the pressure regulator will be set at 30−6.0=24.0 MPa.

The temperature gradient induces an inverse density gradient in the down-flow stream annulus. This will cause buoyancy which could alter the flow paths. Similarly, any gas bubbles will have upward buoyancy. In a short reactor this fluid buoyancy could result in mixing of the heated fluid with colder fluid above, so that oil droplets are exposed to hot water too soon. Buoyancy of bubbles could prevent them from flowing through the reactor. The down-flow velocity may be chosen to avoid this. But for example, in a 1000-m long reactor the flow velocity is chosen so that the fluid flows from top to bottom in 30 minutes at a pumping velocity of 33 m/minute or 0.55 m/second to result in the specified 30 minutes of residence time in the annular channel. In comparison, the density gradient over 1000 m is only 0.00007 g/cm, which gives too low a buoyancy to have a measurable mixing effect. Therefore, the temperature of the fluid will gradually rise as it descends from top to bottom as intended.

Some heat is lost from the reactor casing 14 to the surrounding rock and this will vary from the top of the annulus to the bottom as the temperature difference between the casing and the fluid varies. Heat transfer simulations will include this effect and will determine an increase in the power to the heater to compensate. The power will be set to control the temperature at the distal end of the reactor; this can be measured by a sensor placed at that location. The heat loss is rapid at startup while the rock is still cool and will decline but not cease as the rock is heated. At start up, the system may be heated with only water to allow the temperatures to stabilize. HCM can then be fed with the water to begin upgrading.

The system and methods of this invention are susceptible to many additional variations. The reactor can be scaled up by increasing the diameter of the reactor and all the flow channels or by increasing the length or both. Increasing diameter increases the volume and production capacity by diameter squared, but drilling costs increase rapidly as hole size is increased. Increasing length directly increases production capacity, but requires more power to counter additional heat loss. Another way to scale up is to install reactors in a group of boreholes drilled close together. This has the advantage that each well provides a partial shield against heat loss from adjacent wells. Another variation of the invention can use multiple casings. The invention may also use multiple up-flow channels within a single down-flow channel positioned within a much larger channel that provides the flow in the opposite direction. The invention may also be practiced with a variety of channel arrangements. For example, the central channel may receive the down-flow stream while the annular channel receives the up-flow stream. However, typically placing the cooler feed stream in the outer annulus will minimize heat losses to the surrounding formation. In addition, the reactor may have multiple-pass up-flow and down-flow channels in either separate boreholes or in the same borehole.

In other aspects, this invention may have equipment for feeding a heterogeneous catalyst slurry and/or hydrogen precursors into the feed stream. Such equipment may include suitable pumps and mixers. Preferably the catalyst will comprise particles having an average maximum dimension of 0.1 to 1 mm and more preferably the catalyst will comprise catalyst beads. Typically, the catalyst will comprise transition metal oxides, preferably iron oxide.

In another aspect of the invention an activator is added to the input mixture to react with water and form active hydrogen that contributes to product conversion reactions. The activator preferably increases the amount of lighter hydrocarbons recovered from the reactor and by the method of this invention that have qualities meeting requirements for refining into gasoline or diesel fuel. Preferably the activator comprises hydrogen or a reducing compound and more preferably the activator comprises at least one of formaldehyde, cellulose material or process gas.

Morimoto (28) compared upgrading in supercritical toluene with upgrading in SCW at the same temperatures and time. The conversion was less in toluene, and there was some indication that toluene participated chemically in the reaction. It did show that toluene could be used for this purpose. This shows that other supercritical fluids may be used, although other fluids are not expected to perform better than water.

Not only does upgrading in SCW lower the viscosity of the product, but it also carries out to some extent the refining of bitumen into useful products such as gasoline and diesel fuel. The first step in refining bitumen is to crack or break down heavier components than gasoline or diesel, usually in a delayed coker or fluid cat cracker where hydrogen may be inserted, and SCW upgrading can take the place of such steps. These steps give a product with lower molecular weight that can be distilled to produce gasoline, diesel and other useful products.

Figure 8:
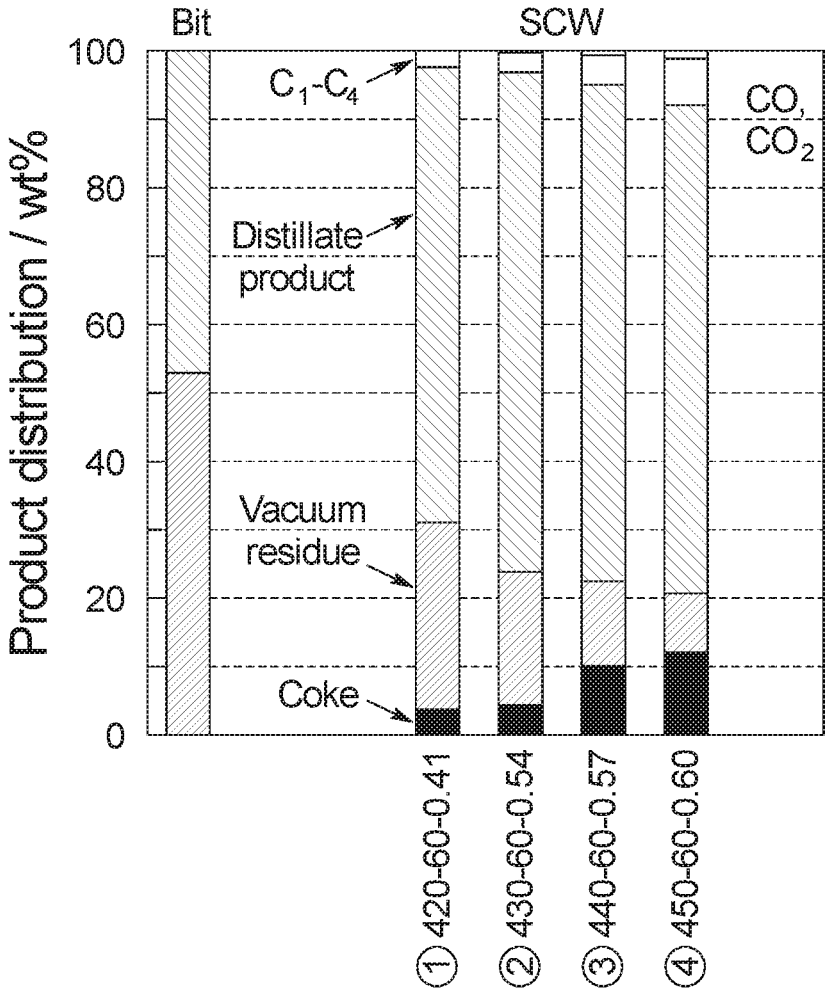
FIG. 8 is a graph representing the composition of several examples of bitumen upgrading.

FIG. 8 from Morimoto (10) shows the changes that take place in SCW upgrading under several sets of conditions. The left bar on the chart shows that bitumen originally contains over 50% of "vacuum distillation residue", a heavy material left over from distillation of bitumen that requires upgrading before refining. The four bars on the right show the composition of products from SCW treatment in a batch reactor at several conditions. The numbers at the bottom indicate the conditions for each case: temperature ° C., reaction time minutes, and fraction of the heavy components converted to a light product that can be separated by distillation. The bars show a substantial conversion of vacuum residue fraction into distillate product, which contains the components that can be directly made into gasoline and diesel in a refinery. The conversion is expected to improve in the reactor of the present invention due to its gradual heating and mixing process. Seen as a hydrogen-free environmentally benign refining step, the process of this invention is one of several refining technologies that may be combined to meet the increasingly stringent requirements for producing clean gasoline and diesel fuels, in addition to its role in making HCM pipeline-transportable.

Removal of sulfur compounds is an important step in the refining of crude oils. Upgrading in SCW decomposes organic sulfides, and SCW has a role as a reactant and as a catalyst so SCW upgrading can provide at least part of the sulfur removal required. See Timko (13) and Sato (12)

It is believed that adding hydrogen or its precursors to the feed should help to cap radicals and thus improve the yield of lower molecular weight products. Hydrogen addition is a key feature of other upgrading processes such as the fluid catalytic cracking process, although there is mostly indirect evidence for this effect in SCW. Sato (29) found that char formation was reduced from 2.5% in SCW to 0.6% in SCW with added hydrogen. These numbers can't be compared with other results given above because experimental conditions were different, but less bitumen going to char should result in higher yield of desired products.

Reactor Design Example

Figure 7:
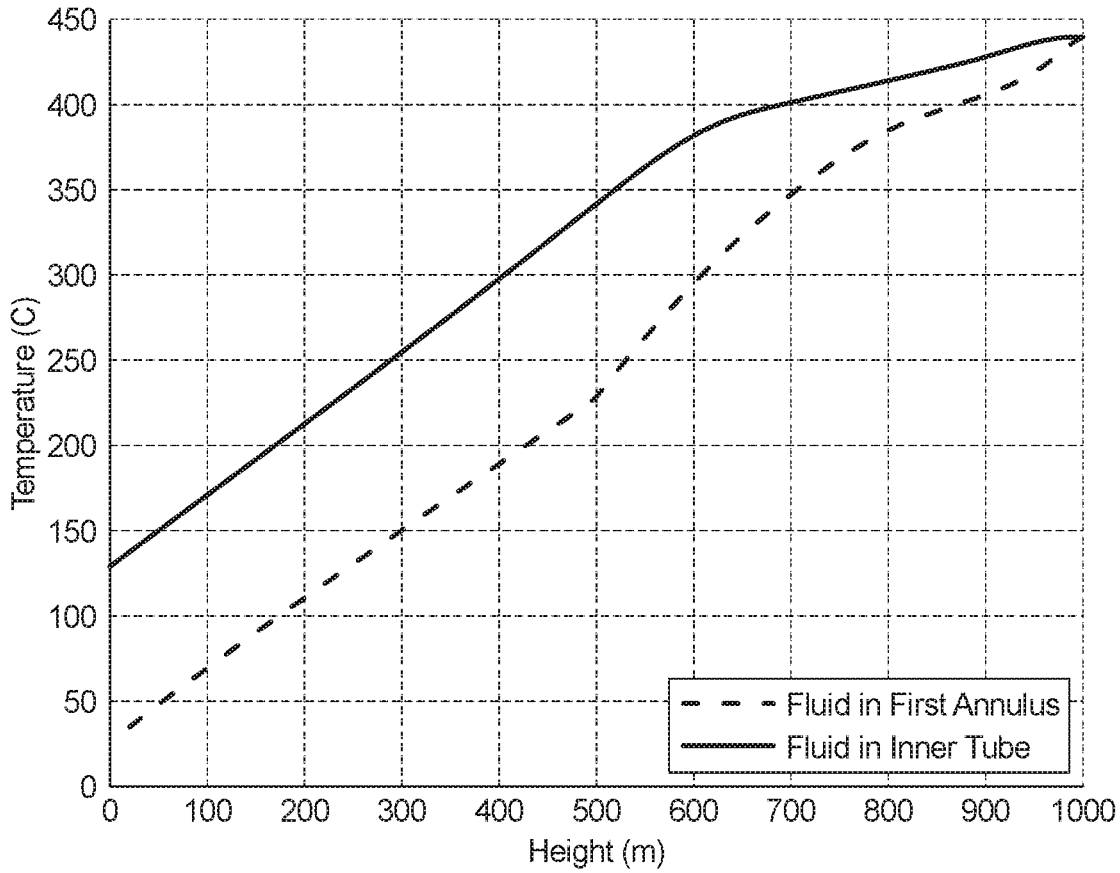
FIG. 7 is a computed graph of the temperatures of the fluids in the flow passages of the reactor.

Time/temperature curves in the annular channel and the central channel were calculated for one example and are given in FIG. 7. FIG. 7 shows temperature profiles in an insulated upgrader 1000 m long at 30 MPa pressure with a production rate of 1440 bbl/day. In this example 2200 KW of power is distributed by the heater over a depth from 500 to 1000 m and the upper half is clad. FIG. 7 shows a lower line representing flow in the down-flow channel and an upper line representing the flow in the up-flow channel.

In this example the model used an electric power input to the heater tubes to maintain the desired feed temperature such that there was a sharply varying enthalpy change of water with temperature and pressure of the water near critical as shown in FIG. 2. The model also accounted for the varying density with temperature along the reactor length along with the heat exchange between the up-flow stream and the down-flow stream, limited only by a fluid film layer adjacent to the tube surfaces. The model assumed that electric heat is generated only in the outer tube because the inner tube is clad with aluminum. The model also accounted for heat loss to the surrounding rock through a layer of aerogel insulation between the reactor casing and the well casing. Although electrical heating may be optional in the distal section, in this example it is active in both the distal section and the middle section.

The model integrates equations with these terms starting with a specified temperature at a reaction zone at the distal end and integrating to the top of the reactor. The model will determine the necessary power input over selected portions of heater length to establish the conversion stream temperature at a specified production rate and water/oil ratio. The feed temperature is selected and the product temperature is computed.

The properties of the product stream recovered from the process may contain more light components similar to those shown from batch experiment in FIG. 8 and discussed above under "Upgrading as a Refining Step."

LIST OF REFERENCES

1. Caniaz, R O, Erkey, C, Process intensification for heavy oil upgrading using supercritical water, Chemical Engineering Research and Design 92 (2014) 1845-1863.
2. Cheng, Z M, Ding, Y., Zhao, L Q, Yuan, P Q, Yuan, W K, Effects of supercritical water in vacuum residue upgrading, Energy and Fuels 23 (2009) 3178-3183.
3. Fedyaeva, O N, Shatrova, A V, Vostrikov, A A, Effect of temperature on bitumen conversion in a supercritical water flow, Journal of Supercritical Fluids 95 (2014), 437-443.
4. Han, L N, Zhang, R, Bi, J C, Cheng, L M, Pyrolysis of coal-tar asphaltene in supercritical water, Journal Analytical and Applied Pyrolysis 91 (2011), 281-287.
5. Kozhevnikov, I V, Nuzhdin, A L, Martyanov, O N, Transformation of petroleum asphaltenes in supercritical water, Journal of Supercritical Fluids 55 (2010), 217-222.
6. Kruse, A, Dinjus, E, Hot compressed water as reaction medium and reactant-Properties and synthesis reactions, Journal of Supercritical Fluids 39 (2007), 362-380.
7. Li, N, Yan, B, Xian-Ming, X, A review of laboratory-scale research on upgrading heavy oil in supercritical water, Energies 8 (2015), 8962-8989.
8. Liu, Y, Bai, F, Zhu, C C, Yuan, P Q, Cheng, Z M, Yuan, W K, Upgrading of residual oil in sub- and supercritical water: an experimental study, Fuel Processing Technology 106 (2013), 281-288.
9. Morimoto, M, Sato, S, Takanohashi, T, Effect of water properties on the degradative extraction of asphaltene using supercritical water, Journal of Supercritical Fluids 68 ((2012), 113-116.
10. Morimoto, M, Sugimoto, Y, Sato, S, Takanohashi, T, Solvent effect of water on supercritical water treatment of heavy oil, Journal Japan Petroleum Institute 57 (1), (2014), 11-17.
11. Morimoto, M, Sugimoto, Y, Sato, S, Takanohashi, T, Bitumen cracking in supercritical water upflow, Energy and Fuels 28 (2014), 858-861.
12. Sato, T, Adschiri, T, Arai, K, Rempel, G L, Ng, FTT, Upgrading of asphalt with and without partial oxidation in supercritical water, Fuel 82 (2003), 1231-1239.
13. Timko, M T, Ghoniem, A F, Green, W H, Upgrading and desulfurization of heavy oils by supercritical water, Journal of Supercritical Fluids 96 (2015) 114-123.
14. Vilcaez, J, Watanabe, M, Watanabe, N, Kishita, A, Adschiri, T, Hydrothermal extractive upgrading of bitumen without coke formation, Fuel 102 (2012), 379-3858.
15. Wu, G, Dabiri, S, Timko, M T, Ghoniem, A F, Fractionation of multi-component hydrocarbon droplets in water at supercritical or near-critical conditions, Journal of Supercritical Fluids 67 (2012), 150-160.
16. Yanik, J, Yuksel, M, Saglam, M, Olukcu, N, Bartle, K, Frere, B, Characterization of the oil fractions of shale oil obtained by pyrolysis and supercritical water extraction, Fuel 74 (1995), 46-50.
17. Leusbrock, I, Metz, S J, Rexwinkel, G, Versteeg, G F, Quantitative approaches for the description of solubilities of inorganic compounds in near-critical and supercritical water, Journal of Supercritical Fluids 47 (2008), 117-127.
18. Bandura, A V, and Lvov, S N, The ionization constant of water over wide ranges of temperature and density, Journal of Physical Chemistry Reference Data 35 (2006), 5-30.
19. Song, C., Lai, W-C, and Schobert, H H, Hydrogen-transferring pyrolysis of cyclic and straight-chain hydrocarbons: https:web.anl.gov/PCS/acsfuel/preprint%20archive/Files/37_4_WASHINGTON%20DC_08-92_1655.pdf
20. Advanced Motor Fuels implementing agreement: http://www.iea-amf.org/content/fuel_information/diesel_gasoline.

21. Zhang, J., Hydrogen production by biomass conversion in supercritical water, CAER, Univ. Kentucky 19 (6) 2008.

22. Mcgee, B. C. W., Electro-Thermal Pilot in the Athabaska Tar Sands, 2008: http://erraus.com.au/images/products/pdf/insitu_electromagnetic_heating.pdf 23. Barton, P., Supercritical separation in Aqueous Coal Liquifaction with Impregnated Catalyst, Ind. Eng. Chem. Process Dev. Des. 589-594, 1983.

24. Ross, D. S. et al, Supercritical Water/CO Liquifaction and a Model for Coal Conversion, Fuel Processing Tech. 12, 277-285, 1986.

25. Onsri, K. et al, Co-Liquifaction of Coal and Used Tire in Supercritical Water, Energy and Power Eng. 2, 95-102, 2010.

26. Asphalt Emulsion Technologies, Transportation Research Circular E-C102, National Academies Press, 2006.

27. Sola, N. Q. Highly concentrated bitumenemulsions review MS thesis, Universitat de Lleida, Escola Politecnica Superior, 2013.

28. Morimoto, M., Sugimoto, Y., Saotome, Y., Sato, S., Takanohashi, T., Effect of supercritical water on upgrading reaction of oil sand bitumen, J. Supercritical Fluids, 55 (2010) 223-231.

29. Sato, T., Tomita, T., Trung, P H, Itoh, N., Sato, S., Takanohashi, T., Upgrading of bitumen in the presence of hydrogen and carbon dioxide in supercritical water, Energy & Fuels, 27 (2013) 646-653.

The invention claimed is:

1. A method of upgrading a feedstock comprising hydrocarbonaceous components while protecting such components from forming char when processed to lighter materials in a reactor comprising an inner tube defining a central channel and an outer tube that together with the inner tube defines an annular channel with both the central and the annular channels extending downwardly into a borehole by a distance of at least 400 feet and having fluid communication at their lower ends, wherein one of the central channel or the annular channel functions as a downflow channel to downwardly transport the feedstock and water; the other of the central channel and the annular channel functions as an upflow channel to upwardly transport a reaction zone effluent having a higher temperature than the feedstock and water; and the inner tube indirectly transfers heat from the upflow channel to the downflow channel, the method comprising:

passing the feedstock and water into an upper zone comprising an upper portion of the downflow channel in which fluid shear is created by contact of the feedstock and water with the walls of the inner tube and the contact decreases the feedstock viscosity due to increased water and feedstock temperature down the length of the upper zone as a result of heat transfer from the upflow channel to the upper zone that increases the temperature of the water and feedstock down the length of the downflow channel and increasing fluid head down the length of the downflow channel that causes an increase in the pressure and density of the water and feedstock and provides an upper mixture;

passing the upper mixture downwardly from the upper zone to a middle zone comprising a middle portion of the downflow channel wherein the temperature in the middle zone of the downflow channel increases at least in part by indirect exchange of heat to the middle zone from the upflow channel across the inner tube thereby raising the solubility of the feedstock in the water to cause at least a portion of the feedstock components to dissolve in the water as the temperature of the mixture in the middle zone attains a temperature above the critical temperature of water but below the temperature and pressure where substantial reaction of the feedstock components occurs to thereby protect at least a portion of the feedstock components from polymerizing to form char when passed into a reaction zone of the reactor by dissolution of the components in the water;

passing the mixture of the middle zone downwardly into a lower portion of the downflow channel and up into a lower portion of the upflow channel that together form the reaction zone and maintaining the temperature and pressure in the reaction zone above critical conditions and in a range that converts a majority of the dissolved feedstock components into a reaction zone effluent that flows up the upflow channel and comprises a hydrocarbonaceous reaction product having lower molecular weight hydro-carbonaceous components than the hydro-carbonaceous components of the feedstock; and, recovering a product stream from an upper portion of the upflow channel.

2. The method of claim 1 wherein the feedstock comprises at least one of bitumen, heavy oil, residual oil, tar, coal, or lignite; the reaction zone has a temperature in a range of 400 to 450° C. and a pressure in a range of 22 to 35 mPa; and the average combined residence time of the input mixture and the conversion mixture hydro-carbonaceous components in the reaction zone is 5 to 60 minutes to form the product stream by controlling the location of heating along the length of the outer channel and the inner channel.

3. The method of claim 1 wherein an activator is added to the upper zone to react with the supercritical water in the middle zone and form active hydrogen; and wherein the activator comprises hydrogen or a reducing compound, the reducing compound including at least one of formaldehyde, cellulose material, organic waste, or process gas.

4. The method of claim 1 where, in addition to the indirect heat exchange, heating is provided by electric heating that is generated in the material of the inner and/or outer tube by a skin effect, the electric heating is provided to at least one of the middle zone or an upper portion of the lower zone and the proportion of electric heating provided for each zone receiving the heating is adjusted by selecting the material of the inner and/or outer tube.

5. The method of claim 4 where the material of the inner and outer tubes is steel and the heating effect of the tubes is altered by cladding or lining portions of at least one of the inner or outer tubes with aluminum or other nonmagnetic electrically conductive material.

6. The method of claim 4 where the electric heating is provided at a selected frequency, and the frequency is chosen to adjust the heating of the material of the inner and outer tubes in each zone.

7. The method of claim 1 where the hydro-carbonaceous reaction product flowing up the upflow channel remains in solution until the temperature of the reaction product drops to a temperature that protects the hydro-carbonaceous reaction product from forming char.

8. The method of claim 1 wherein the reactor is sited near the feedstock sources its viscosity is reduced so that it can be shipped by pipeline.

9. The method of claim 1 wherein the feedstock and water flow down the annular channel and the reaction zone effluent flows up the upflow channel.

10. A method of upgrading a feedstock comprising hydrocarbonaceous components while protecting such components from forming char when processed to lighter materials in a reactor comprising an inner tube defining a central channel and an outer tube that together with the inner tube defines an annular channel with both the central and the annular channels extending downwardly into a borehole by a distance of at least 400 feet and having fluid communication at their lower ends, wherein one of the central channel or the annular channel functions as a downflow channel to downwardly transport the feedstock and water; the other of the central channel and the annular channel functions as an upflow channel to upwardly transport a reaction zone effluent having a higher temperature than the feedstock and water; and the inner tube indirectly transfers heat from the upflow channel to the downflow channel, the method comprising:

passing the feedstock; water and an activator into an upper zone comprising an upper portion of the downflow channel in which the activator reacts with the water and forms active hydrogen and wherein fluid shear is created by contact of the feedstock and water with the walls of the inner tube and the outer tube and the contact decreases the feedstock viscosity due to increased water and feedstock temperature down the length of the upper zone as a result of heat transfer from the upflow channel to the upper zone that increases the temperature of the water and feedstock down the length of the downflow channel and increasing fluid head down the length of the downflow channel that causes an increase in the pressure and density of the water and feedstock and provides an upper mixture;

passing the upper mixture downwardly from the upper zone to a middle zone comprising a middle portion of the downflow channel wherein the temperature in the middle zone of the downflow channel increases at least in part by indirect exchange of heat to the middle zone from the upflow channel across the inner tube thereby raising the solubility of the feedstock in the water to cause at least a portion of the feedstock components to dissolve in the water as the temperature of the mixture in the middle zone attains a temperature above the critical temperature of water but below the temperature and pressure where substantial reaction of the feedstock components occurs to thereby protect at least a portion of the feedstock components from polymerizing to form char when passed into a reaction zone of the reactor by dissolution of the components in the water;

passing the mixture of the middle zone downwardly into a lower portion of the downflow channel and up into a lower portion of the upflow channel that together form the reaction zone and maintaining the temperature and pressure in the reaction zone above critical conditions and in a range that converts a majority of the dissolved feedstock components into a reaction zone effluent that flows up the upflow channel and comprises a hydrocarbonaceous reaction product having lower molecular weight hydro-carbonaceous components than the hydro-carbonaceous components of the feedstock; and, recovering a product stream from an upper portion of the upflow channel.

11. The process of claim 10 wherein the activator is hydrogen or a reducing compound.

12. The process of claim 11, wherein the reducing compound includes at least one formaldehyde, cellulose material, organic waste, or process gas.

* * * * *